United States Patent [19]

Lai

[11] Patent Number: 4,917,521

[45] Date of Patent: Apr. 17, 1990

[54] PEN TYPE CONTAINER FOR CORRECTION FLUID WITH DAUBING FUNCTION

[76] Inventor: Kung-Chung Lai, No. 100-1 Sec. 2, Ho Pin West Rd., Taipei, Taiwan

[21] Appl. No.: 310,868

[22] Filed: Feb. 15, 1989

[51] Int. Cl.[4] ..... B43K 8/00; B43K 1/06

[52] U.S. Cl. ..... 401/260; 222/469; 222/507; 222/518; 401/264

[58] Field of Search ..... 401/260, 264, 279, 263, 401/102, 277; 222/469, 470, 507, 517, 518

[56] References Cited

U.S. PATENT DOCUMENTS

| | | | |
|---|---|---|---|
| 234,035 | 11/1880 | Houts | 222/518 |
| 1,009,612 | 11/1911 | Wold | 401/264 |
| 1,085,839 | 2/1914 | Acton | 401/279 |
| 1,429,561 | 9/1922 | Berry | 222/507 |
| 3,281,887 | 11/1966 | Raffe | 401/263 X |
| 3,804,539 | 4/1974 | Sussman et al. | 401/260 X |

FOREIGN PATENT DOCUMENTS

| | | | |
|---|---|---|---|
| 342587 | 6/1920 | Fed. Rep. of Germany | 401/102 |

*Primary Examiner*—Steven A. Bratlie

*Attorney, Agent, or Firm*—Esso Int'l Patent and Trademark Office

[57] ABSTRACT

A pen type dispenser structure attachable to a container for ink correction liquid. The dispenser includes a frusto-conical liner wall formed into a spiral configuration; a shaft extends from the small end of the liner wall into a liquid discharge opening formed in the tip end of a surrounding cover. A manually-squeezable lever is mounted on the container for rotating the cover. A wedge surface on the cover interior surface is slidably engaged with a wedge surface on the spiral liner wall, such that rotation of the cover causes the spiral liner to move the internal shaft away from the liquid discharge opening at the tip end of the cover.

1 Claim, 3 Drawing Sheets

PEN TYPE CONTAINER FOR CORRECTION FLUID WITH DAUBING FUNCTION

BACKGROUND AND SUMMARY OF THE INVENTION

This invention relates to a dispenser mechanism for ink correction liquid. Conventional liquid dispenser mechanisms for a similar purpose resemble ball pen type devices wherein a spring-urged ball is arranged within the discharge end of a liquid passage so that the ball surface is adapted to engage the paper surface; liquid is dispensed by pressing the mechanism downward against the paper surface so that the ball retracts into the passage thereby permitting liquid to flow from the passage onto the paper surface.

The requirement for manual pressure to achieve liquid dispensing somewhat impedes flow onto areas of the paper in direct contact with the ball surface. Additionally, the tip end of the passage structure tends to become immersed in the dispensed liquid, thereby scraping some of the liquid from the paper surface. Also, the paper must be positioned on a flat hard surface in order for the ball to properly retract into the liquid passage for dispensing purposes.

The present invention relates to a liquid dispenser mechanism that does not have to come into direct contact with a paper surface in order to achieve a liquid dispensing action. Pressure contact between the dispenser and the paper surface is not required. The mechanism thus avoids some of the problems associated with conventional spring-urged ball type dispensers.

In a preferred form, the invention comprises a frusto-conical cover rotatably fitting onto a spiral frusto-conical elastic liner wall that extends from a bottle containing ink correction liquid; the flow control element comprises a shaft extending from the spiral wall. A manually actuable lever mechanism is mounted on the bottle for rotating the cover, to axially contract the spiral liner wall and thus achieve a liquid dispensing action. Achievement of the dispensing action does not depend on contact with the paper surface or the application of external pressure to the flow control element.

THE DRAWINGS

DESCRIPTION OF A PREFERRED EMBODIMENT OF THE INVENTION

Figure 1:
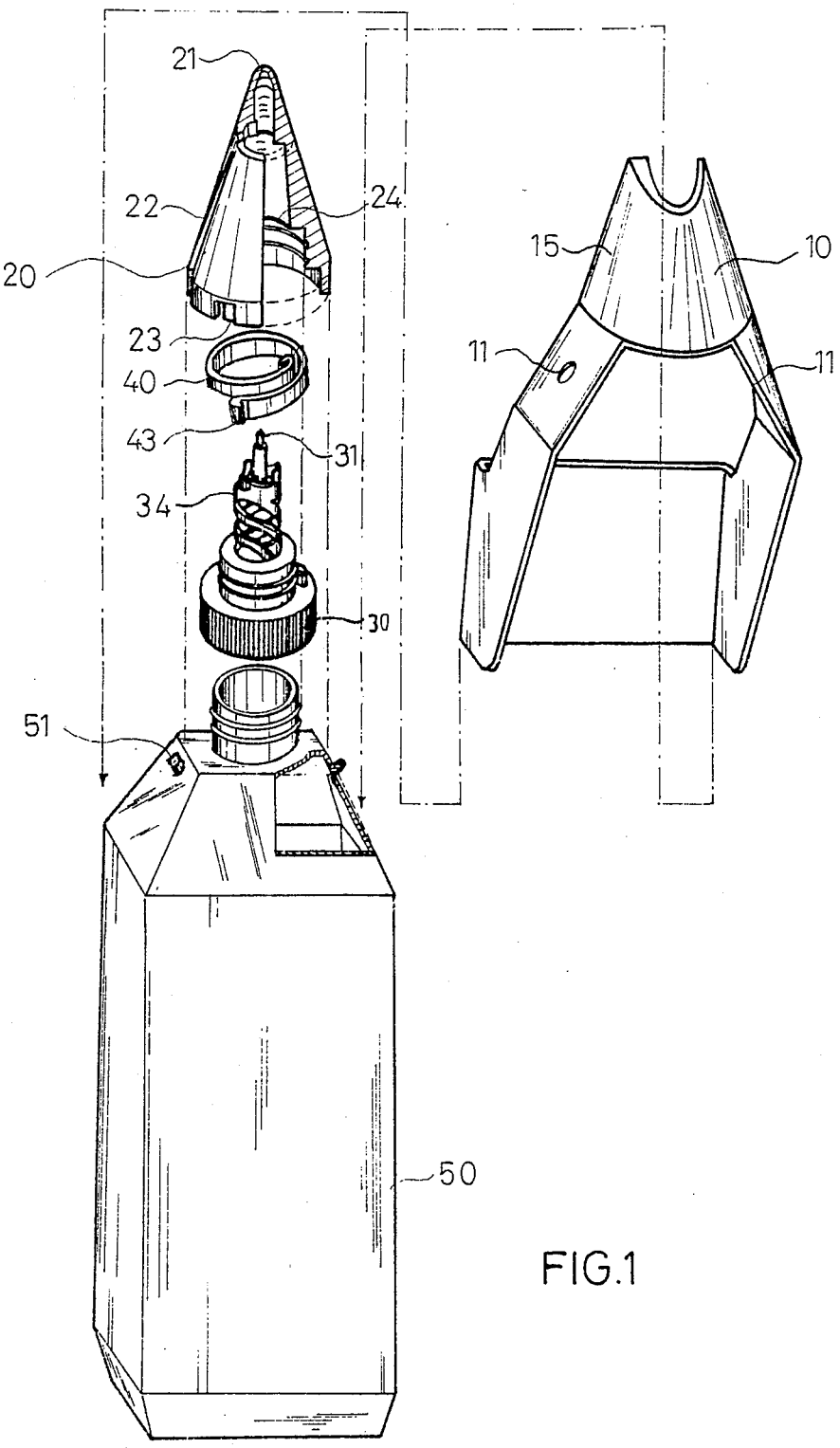
FIG. 1 is an exploded view of componentry used in a dispenser mechanism embodying the invention.

FIG. 1 shows a liquid dispenser mechanism adapted to be secured to the discharge opening of a container (bottle) 50. The container is of the type commonly used to contain ink correction liquid.

Figure 2:
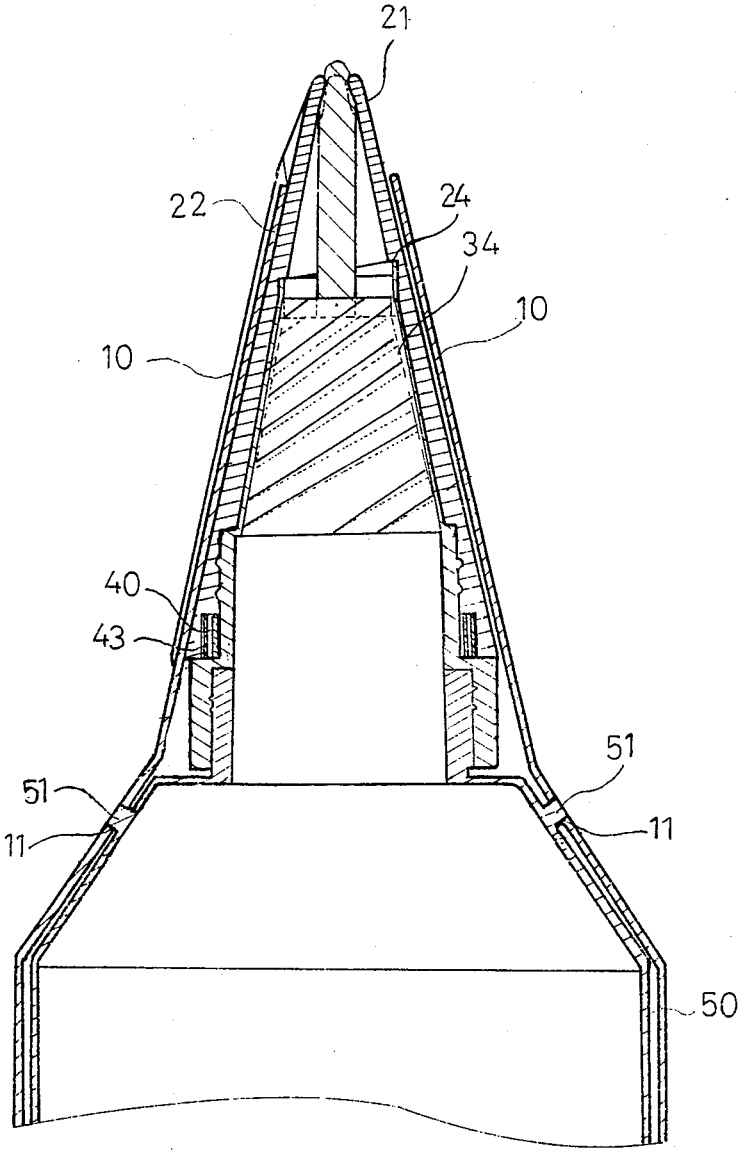
FIG. 2 is a sectional view taken through the dispenser shown in exploded form in FIG. 1.

The dispenser mechanism includes a hollow liner element 30 formed of an elastic plastic material. This hollow liner element includes a relatively large diameter cylindrical section at its lower end adapted to have a snap fit on the upstanding neck area of bottle 50, as shown in FIG. 2. Liner element 30 also includes a frusto-conical spiral wall extending axially from bottle 50 within a space circumscribed by an annular cover 20. A shaft 31 projects axially from the small end of the hollow frusto-conical spiral wall element. As shown in FIG. 2, the tip of this shaft projects through an opening 21 in the associated cover. The contour of the tip end of the shaft conforms to the contour of the internal surface defined by opening 21, such that in its FIG. 2 position the projecting shaft prevents liquid from passing through opening 21.

Figure 3:
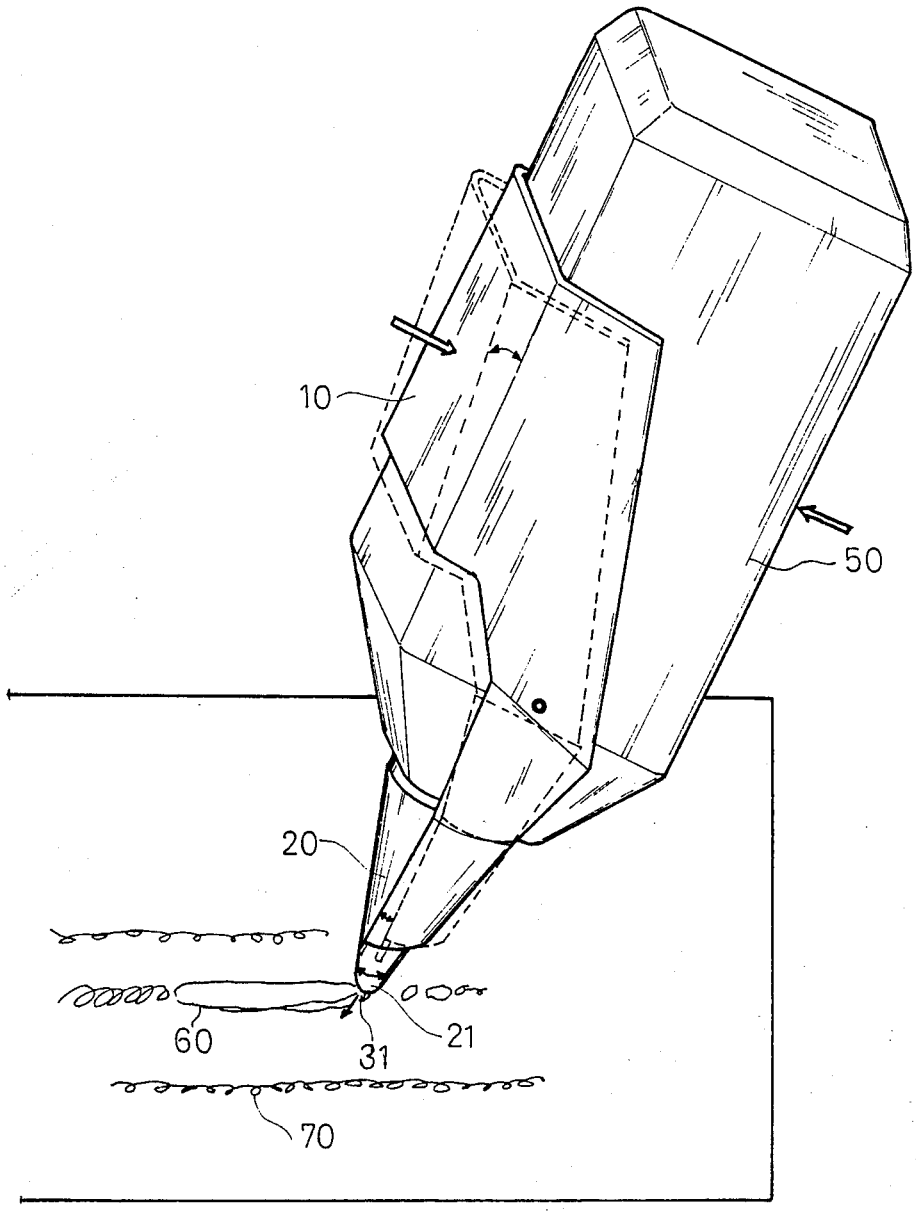
FIG. 3 is a perspective view of the FIG. 2 dispenser mechanism in usage for dispensing liquid onto a paper surface.

The frusto-conical spiral wall section of annular liner element 30 is formed of an elastic plastic material. Also, the frusto-conical spiral wall has a relatively thin wall thickness (cross-section), such that the frusto-conical wall can contract axially toward bottle 50 or expand axially away from bottle 50 in response to rotary movements of cover 10.

the free end edge of the spiral wall forms a helical tooth (or wedge) surface 34 that is in slidable engagement with a helical tooth (or wedge) surface 24 formed on cover 10. Rotary movement of cover 10 in one direction causes the spiral wall element to retract away from discharge opening 21, thereby withdrawing shaft 31 a slight distance away from opening 21. This slight movement is sufficient to permit ink correction liquid to flow through opening 21 (assuming the mechanism is overturned as shown in FIG. 3). Liquid flow is gravitational in character. The liquid flows through the space circumscribed by the spiral wall, and thence through the space surrounding shaft 31 into opening 21.

Cover 20 is rotatably mounted on the large diameter end of liner element 30. As shown in FIG. 2, element 30 is formed with two circumferential ribs that fit within internal circumferential grooves formed on the lower (large diameter) end of cover 20. The cover can thus rotate freely relative to liner element 30 (whose lower end is immovably attached to container 50).

Cover 20 has a frusto-conical cross section mated to the outer surface contour of liner element 30. The small end of cover 20 forms the liquid discharge opening 21. As above noted, the cover is rotatable relative to liner element 30.

A manually-operated lever mechanism 10 is provided for rotating cover 20 in the direction that will cause liner element 30 to retract shaft 31 away from discharge opening 21. A spiral spring 40 is provided to rotate cover 20 in the opposite direction, i.e. the direction that will cause liner element 30 to move shaft 31 to a position closing the liquid discharge opening 21.

Lever mechanism 10 is pivotably attached to container 50 for swinging motion around an axis extending transversely across the container axis. The pivot-type attachment structure comprises two pins 51 extending from the container into holes 10 and 11 in the lever mechanism (see FIG. 1). The lever mechanism surrounds the container along three of its side surfaces to form a flat manually-actuable wall extending along the container side wall. A manual squeezing pressure, indicated by the arrows in FIG. 3, will cause the lever mechanism to swing around its pivot axis from the dashed line position to the full line position, thereby rotating cover 20 around its central axis.

The drive connection from lever mechanism 10 to cover 20 comprises an external groove 22 formed on cover 20. Wall 15 of the lever mechanism extends into groove 22, such that pivotable motion of the lever mechanism, from the dashed line position to the full line position, causes cover 20 to rotate around its central axis.

The aforementioned spiral spring 40 extends within a circular counterbore in the lower end of cover 20 as shown in FIG. 2. The spring makes one complete turn around the outer surface of the lower end of liner element 30. An outturned end 43 of the spring extends into a notch (cavity) 23 in cover 20 to attach the spring to the cover. The other end of spring 40 is inturned to hook around a projection at the lower end of liner element 30. The spring 40 is torsionally deflected when manual squeeze pressure is applied to lever 10 (per the arrows in FIG. 3). When the squeeze pressure is removed, the spring force returns cover 20 to its initial position (prior to application of the squeeze pressure). As cover 20 returns to its initial position the elasticity of the spiral wall section to expand away from container 50, thereby moving shaft 31 to a position closing the liquid discharge opening 21. The surfaces of teeth 24 and 34 remain in slidable engagement with one another during this time.

I claim:

1. In association with a container (50) for ink correction liquid, the improvement comprising a liquid dispenser mechanism that includes:

a hollow liner element (30) having a relatively large diameter end thereof adapted to immovably fit onto the discharge end of the container so that liquid can flow from the container through the space circumscribed by the liner element, said liner element including a hollow spiral wall having a frusto-conical configuration extending away from the aforementioned large diameter end to form a small diameter free end; said frusto-conical spiral wall being formed of an elastic material capable of resilient deformation in the axial direction;

an axial shaft (31) extending from the small diameter end of the hollow liner element away from the space circumscribed by the liner element;

a hollow frusto-conical cover (20) fitting onto the hollow liner element, said cover having a large diameter end section rotatably fitting around the large diameter end of the liner element whereby the cover can be manually rotated without changing its axial position relative to the large diameter end of the liner element; said cover including a frusto-conical wall extending along and beyond the liner element to form a liquid-discharge opening (21) surrounding the tip of said axial shaft (31); mating helical wedge surfaces (34,24) formed on the small diameter end of the liner element frusto-conical wall and the inner surface of the frusto-conical cover; the mating wedge surfaces being configured so that rotation of the cover in a first direction causes the wedge surface on the cover to exert an axial cam force on the wedge surface of the liner element, such that the elastic wall contracts toward the large diameter end of the liner element, thereby pulling said axial shaft from a closed position wherein its tip is engaged with the discharge opening (21) to an open position wherein said tip is spaced from the discharge opening;

manual means (10) for applying a rotary operating force to the cover, said manual means comprising a lever element pivotably attached to the associated container (at 51) for swinging motion around an axis extending transversely across the container axis;

said cover (20) having an external groove (22) in its outer surface, said lever element having an inturned end wall 915) extending into said external groove, whereby swinging motion of said lever element toward the container causes the cover to rotate in the aforementioned first direction;

and a torsion spring (40) extending around the hollow liner element with its opposite ends connected, respectively, to the cover and to the large diameter end of the liner element, said spring being oriented to rotate the cover in a second direction when manual pressure is removed from the lever element.

* * * * *